US009089222B2

(12) United States Patent
Stewart et al.

(10) Patent No.: US 9,089,222 B2
(45) Date of Patent: Jul. 28, 2015

(54) SIMULATED PLATFORM BED PANEL SYSTEM

(75) Inventors: Richard Stewart, Mason, OH (US); Saravan Muthanandam, Loveland, OH (US)

(73) Assignee: Standard Textile Co., Inc., Cincinnati, OH (US)

( * ) Notice: Subject to any disclaimer, the term of this patent is extended or adjusted under 35 U.S.C. 154(b) by 102 days.

(21) Appl. No.: 13/434,238

(22) Filed: Mar. 29, 2012

(65) Prior Publication Data

US 2013/0117932 A1 May 16, 2013

Related U.S. Application Data

(60) Provisional application No. 61/558,506, filed on Nov. 11, 2011.

(51) Int. Cl.
*A47C 19/02* (2006.01)
*A47C 19/00* (2006.01)

(52) U.S. Cl.
CPC ..... *A47C 19/025* (2013.01); *A47C 19/005* (2013.01); *A47C 19/02* (2013.01); *A47C 19/021* (2013.01); *A47C 19/022* (2013.01); *Y10T 29/49826* (2015.01)

(58) Field of Classification Search
CPC ..... A47C 19/005; A47C 19/02–19/025; Y10T 29/49826
USPC ..... 5/400, 425, 282.1, 200.1, 420, 285, 5/279.1
See application file for complete search history.

(56) References Cited

U.S. PATENT DOCUMENTS

| | | | | |
|---|---|---|---|---|
| 2,671,910 | A * | 3/1954 | Wallen | 5/280 |
| 4,364,134 | A * | 12/1982 | Marks | 5/201 |
| 6,951,037 | B2 * | 10/2005 | Weinman et al. | 5/618 |
| 6,990,698 | B2 * | 1/2006 | Wall, Sr. | 5/618 |
| 7,845,030 | B1 * | 12/2010 | Pollard | 5/308 |
| 7,865,981 | B2 * | 1/2011 | Harrow | 5/400 |

FOREIGN PATENT DOCUMENTS

GB 2097665 A * 11/1982

* cited by examiner

*Primary Examiner* — Peter M Cuomo
*Assistant Examiner* — Brittany Wilson
(74) *Attorney, Agent, or Firm* — Wood, Herron & Evans, LLP

(57) ABSTRACT

A simulated platform bed panel system is designed for use with a bed system such as a bed frame adapted to support a mattress above a floor surface. The simulated platform bed panel system creates the appearance of a platform bed upon which the mattress appears to be supported and includes first and second generally rectangular side panels. The simulated platform bed panel system also includes a generally rectangular foot panel. Each of the panels has an exterior aspect having a decorative feature, and the panels are cooperable to be situated in a set defining a U-shape with the exterior aspects directed outwardly. The side panels define the legs and the foot panel defines the yoke of the U-shape. The panels may be rigid and/or may have top sides which are free relative to each other.

99 Claims, 8 Drawing Sheets

SIMULATED PLATFORM BED PANEL SYSTEM

RELATED CASES

This application claims priority of U.S. Provisional Patent Application No. 61/558,506, which was filed on Nov. 11, 2011 and is incorporated herein by reference in its entirety.

TECHNICAL FIELD

The present invention generally relates to bed furniture, and more particularly to providing a desired aesthetic appearance simulating a platform bed for a bed system.

BACKGROUND

Typical bed systems include a mattress supported above a floor surface by a mattress support. As is widely known, mattresses come in certain sizes, such as twin, full, queen, and king, by way of example, each having a respective width between sides and a respective length between the head and the foot thereof. One popular type of mattress support is a platform bed. Platform beds have an aesthetic style that is regarded by some as desirable. Platform beds are formed by rigidly joining together rigid wood panels that form a solid frame on which the mattress is supported, with the panels resting upon and extending upwardly from a floor surface to above the bottom edge of the mattress. The panels thus completely surround the bottom exterior of the mattress while also blocking off access, visually and otherwise, to the area below the mattress. The panels on the sides of the mattress must have a length corresponding to the length of the mattress, and the panels at the head and/or foot must have a width corresponding to the width of the mattress so that the mattress can be received therebetween. The panels must also be able to support the full weight of the mattress and any people and/or things thereon. The exterior aspects of the panels of the platform bed present an aesthetically desirable appearance due, typically, to the wood grain and/or staining thereof. But platform beds are generally very expensive, thus limiting their availability in many settings. Moreover, they are typically also quite heavy which limits the ability of their owners to move them around within a bedroom as desired.

A much lower cost, and more easily transportable mattress support, is provided by a simple, metal bed frame. The bed frame is typically characterized by L-shaped side rails that are spaced apart to match the width of the mattress with an exterior portion sitting astride the edges of the mattress, or a foundation supporting and sized to match the mattress. The side rails are joined by lateral rails to define the bed frame, but the side rails are typically shorter than the length of the mattress so as not to project out to or beyond the foot end of the mattress supported thereon. The mattress may be placed directly on the frame, or a box spring or foundation may be placed on the bed frame with the mattress supported thereon. The mattress is thus supported above the floor surface, but with a much less costly and lighter form of mattress support than that provided by a platform bed. But, these simple bed frames present their own drawbacks. For example, the frame may have legs that rest on the floor surface, but the area below the mattress is otherwise exposed and open. And the frames themselves, to the extent they present an exterior portion, such as the side rails and/or flanges, are not particularly desirable from an aesthetic standpoint.

SUMMARY OF THE INVENTION

The present invention provides a simulated platform bed panel system useable with a bed system to effectively simulate the aesthetic appearance of a platform bed without the drawbacks thereof. To that end, and in accordance with the principles of the present invention, a simulated platform bed panel system is provided by two generally rectangular side panels and a generally rectangular foot panel, each with a decorative feature on an exterior aspect thereof and having a height about equal to the distance a mattress is to be supported above the floor surface by a mattress support of a bed system, such as a simple bed frame. The panels are positionable into a set having a U-shape with the side panels defining the legs of the U-shape and having a length corresponding to the length of the mattress and the foot panel defining the yoke thereof and having a width corresponding to the width of the mattress. The U-shaped set can be positioned about the bed frame or other mattress support with the side panels astride the sides of the bed frame and the foot panel spanning between the side panels at the foot end of the bed frame so as to create the appearance of a platform bed.

The panels of the simulated platform bed panel system are advantageously rigid or of rigid segments (which may be hinged together, for example, and considered to define a rigid panel), but are generally lighter than the panels making up a traditional platform bed since they do not need to support the weight of the mattress, which is already supported by a mattress support of the bed system. Instead, the simulated platform bed panel system of the present invention is easily situated about the bed frame without requiring the heft and bulk needed to support the mattress. Also, because they are lighter, they can be more easily moved around within a room or between locations.

Additionally, while the side panels may be connected to the foot panel, for example, the connection need not be as robust as that between panels of a platform bed. Advantageously, the side and foot panels are connected by brackets. In that regard, when the panels are positioned into a U-shape set, the bottom sides of the panels are advantageously situated to rest adjacent a floor surface, with the top sides of at least the side panels being free relative to each other, i.e., without any intervening structure connecting the respective top sides of at least the side panels to each other. The top side of the foot panel may also be free relative to one or both of the side panels. Nor is there a need for a head end panel or headboard, although one may be provided if desired.

One or more of the panels, such as a side panel, may also be connected to the bed frame, such as with a bracket attached to the head end of the mattress support. But the simulated platform bed panel system can still be easily moved either with the bed frame, or by easily disconnecting the panel(s) from the bed frame and relocating the panels. In that way, access to the area under the mattress is easily achieved, and where necessary or desirable, one or more of the panels may be replaced to either affect a repair or to change the aesthetic appearance provided by the panels.

In some embodiments of the present invention, the decorative feature of the panel exterior aspects may be provided by upholstery wrapped about the panel so as to cover at least the exterior aspect thereof. In particularly advantageous embodiments of the present invention, the decorative feature is provided by such wrapped upholstery with the upholstery also defining a pocket at the ends of the panels for receipt of a corner panel. In that regard, the foot panel meets up with the side panels at respective corner junctions which, in some embodiments, may not present a smooth or clean transition between the side and foot panels. To that end, a flexible corner panel is sized to fit within the pocket of a side panel and a pocket of the foot panel so as to extend over the corner junction. The corner panel advantageously has a decorative feature that matches with the decorative feature of the panels.

The simulated platform bed panel system of the present invention may be combined with a bed system including at least a mattress support and a mattress to provide a simulated platform bed. The simulated platform bed panel system may also be provided as a framing kit containing the side and foot panels and brackets to connect the panels and to connect one or more of the panels to a bed frame or other mattress support of a bed system. The framing kit may also include the corner panels.

By virtue of the foregoing, there is thus provided a simulated platform bed panel system useable with a bed system that simulates the aesthetic appearance of a platform bed. These and other advantages of the present invention shall be made apparent from the accompanying drawings and the description thereof.

BRIEF DESCRIPTION OF THE DRAWINGS

The accompanying drawings, which are incorporated in and constitute a part of this specification, illustrate embodiments of the invention and together with the general description of the invention given above and the detailed description of the embodiments given below, serve to explain the principles of the present invention.

DETAILED DESCRIPTION OF THE DRAWINGS

Figure 1:
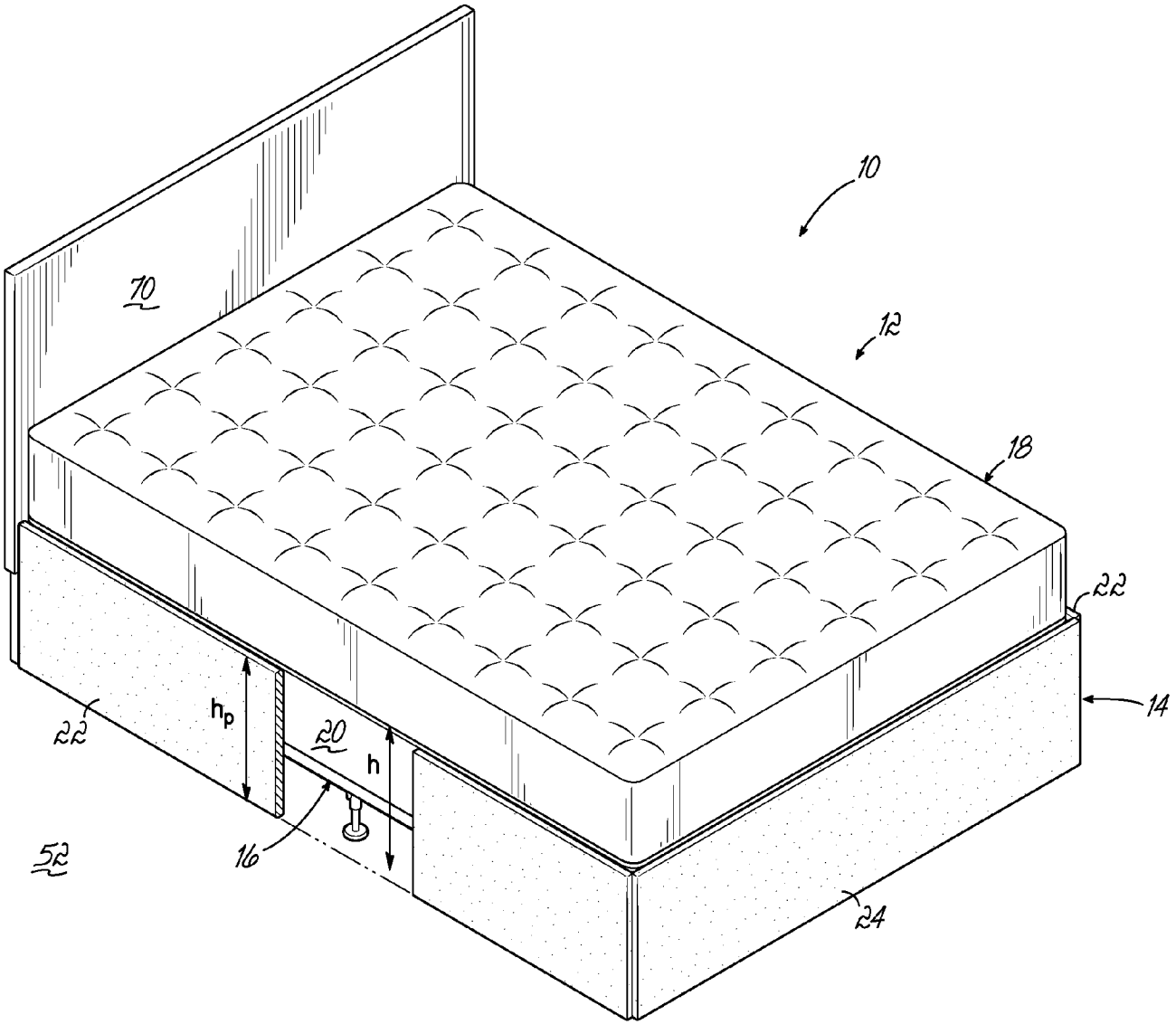
FIG. 1 is a perspective, partially cut-away view of a simulated platform bed including an exemplary bed system and an embodiment of a simulated platform bed panel system according to the principles of the present invention.

Referring now to the figures and beginning with FIG. 1, a simulated platform bed 10 is shown for purposes of explaining the principles of the present invention. To that end, the simulated platform bed 10 includes a bed system 12 which may be of conventional construction, and a simulated platform bed panel system 14 according to the principles of the present invention. Bed system 12 includes a mattress support 16 (which, in the exemplary embodiment shown is a simple, metal bed frame 16) and a bed mattress 18 supported by the mattress support 16. Although the mattress 18 could be supported directly on the bed frame 16, in the embodiment shown, mattress 18 is indirectly supported on bed frame 16 by a foundation 20 (which, by way of example, could be a box spring, a foam web, slats, or a plywood sheet) supported directly on the bed frame 16 with the mattress 18 supported directly on the foundation 20. The simulated platform bed panel system 14 includes side panels 22 and a foot panel 24. As will become evident, the simulated platform bed panel system 14 creates the appearance of a platform bed upon which the mattress 18 appears to be supported. Particularly, it will be appreciated that the mattress 18 is supported by the bed frame 16, and not the panels 22, 24, which provide the appearance of a platform bed.

Figure 2:
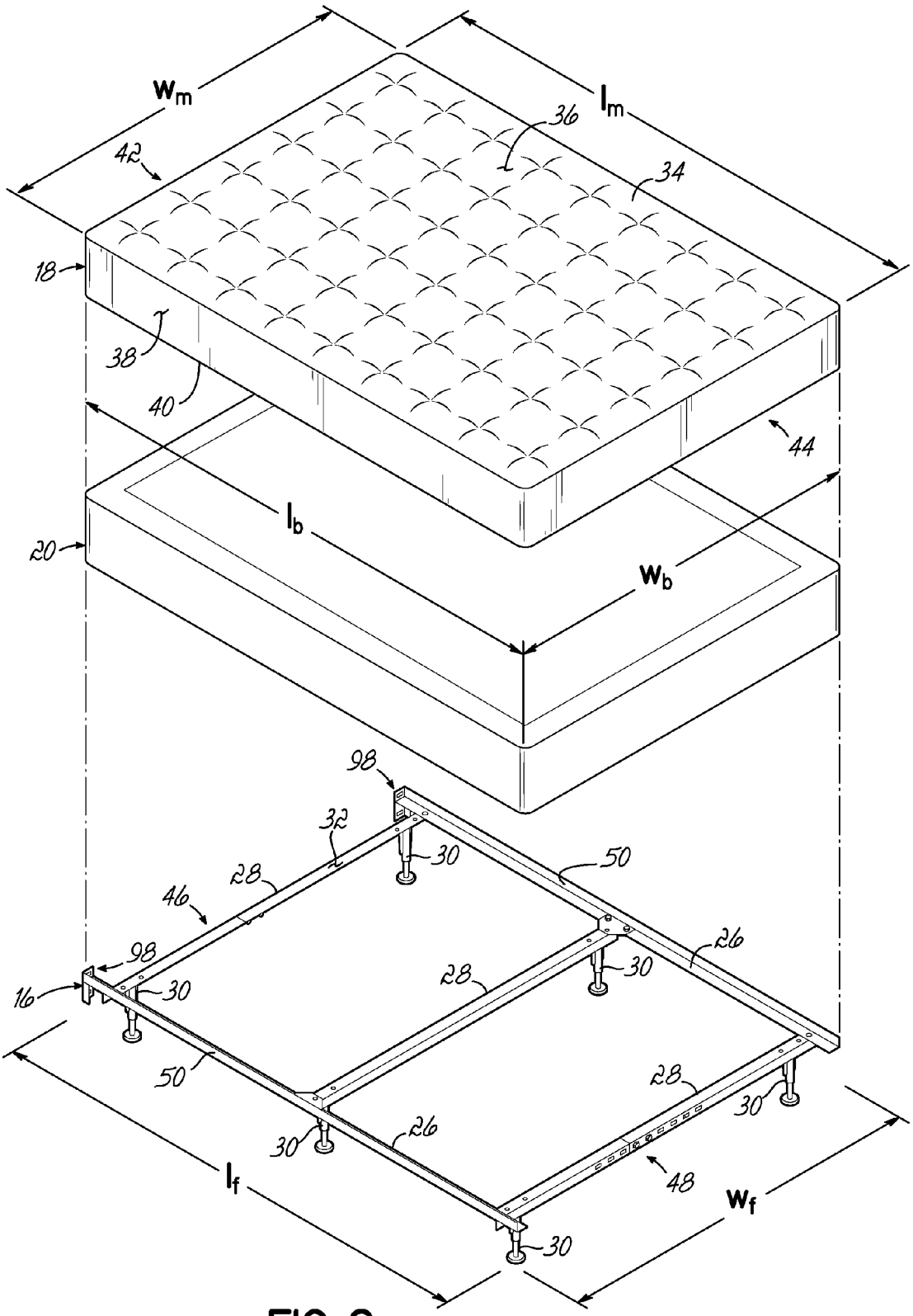
FIG. 2 is an exploded, perspective view of the bed system of FIG. 1 to facilitate an explanation of the principles of the present invention.

With reference to FIG. 2, the bed frame 16 of the bed system 12 is a conventional metal bed frame 16 and includes lengthwise-extending L-shaped rails 26 and widthwise-extending or lateral rails 28. Legs 30 are provided generally near the four corners of the bed frame 16, and for larger bed systems such as for queen or king mattresses 18, midstream of the bed frame 16 such as along the lengthwise and widthwise-extending rails 26, 28. The lengthwise and widthwise-extending support rails 26, 28 cooperate to define a support surface 32 upon which the foundation 20 is placed with the mattress 18 supported thereon as is conventional.

The mattress 18 is a conventional mattress and may be any size, such as, for example, twin, full, queen, king, or the like. The mattress 18 is covered in upholstery 34 and includes an upper surface 36, sides 38 and a lower surface 40. The mattress 18 has a length $l_m$ along the sides 36 between a head 42 and a foot 44 and a width $w_m$ in the other direction between opposed sides 36. The length and width dimensions of the foundation 20 generally match those of the mattress 18, with the foundation 20 having a length $l_b$ and a width $w_b$.

The bed frame 16 is configured to accommodate the foundation 20 and the mattress 18. Particularly, the bed frame 16 has a length $l_f$ extending between a head end 46 and a foot end 48 and a width $w_f$. While the length $l_f$ of the bed frame 16 is approximately equal to the length $l_m$ of the mattress 18, it will be appreciated that the length $l_m$ of the mattress 18 may be slightly greater than the length $l_f$ of the bed frame 16 if a portion of the mattress 18 extends slightly beyond the foot end 48 of the bed frame 16. Also, while the width $w_f$ of the bed frame 16 is approximately equal to the width $w_m$ of the mattress 18, the width $w_f$ of the bed frame 16 may be slightly greater than the width $w_m$ of the mattress 18 to allow the exterior aspects or flanges 50 of side rails 26 to extend upwardly alongside the foundation 20 (or mattress 18 if directly on bed frame 16). As seen in FIG. 1, with legs 30 setting on a floor surface 52, the mattress 18 is supported a first height h above the floor surface 52.

Figure 3:
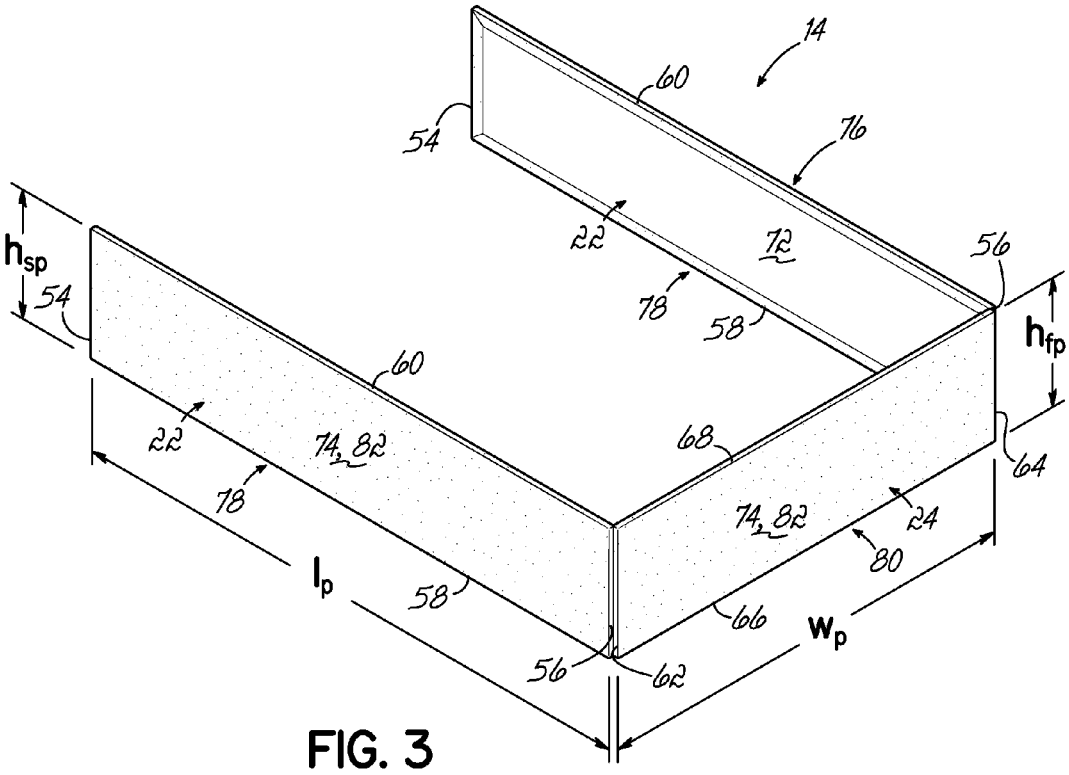
FIG. 3 is a perspective view of the simulated platform bed panel system of FIG. 1 with the side panels and foot panel thereof situated in a set defining a U-shape in accordance with the principles of the present invention.
Figure 4A:
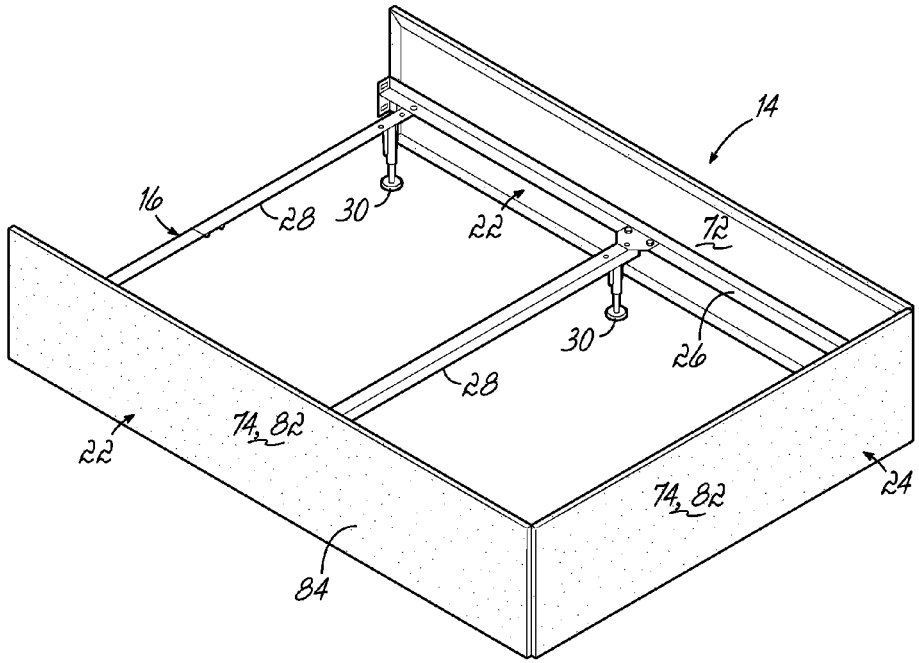
FIG. 4A is a perspective view of the simulated platform bed panel system and a bed frame of the bed system of FIG. 1.
Figure 4B:
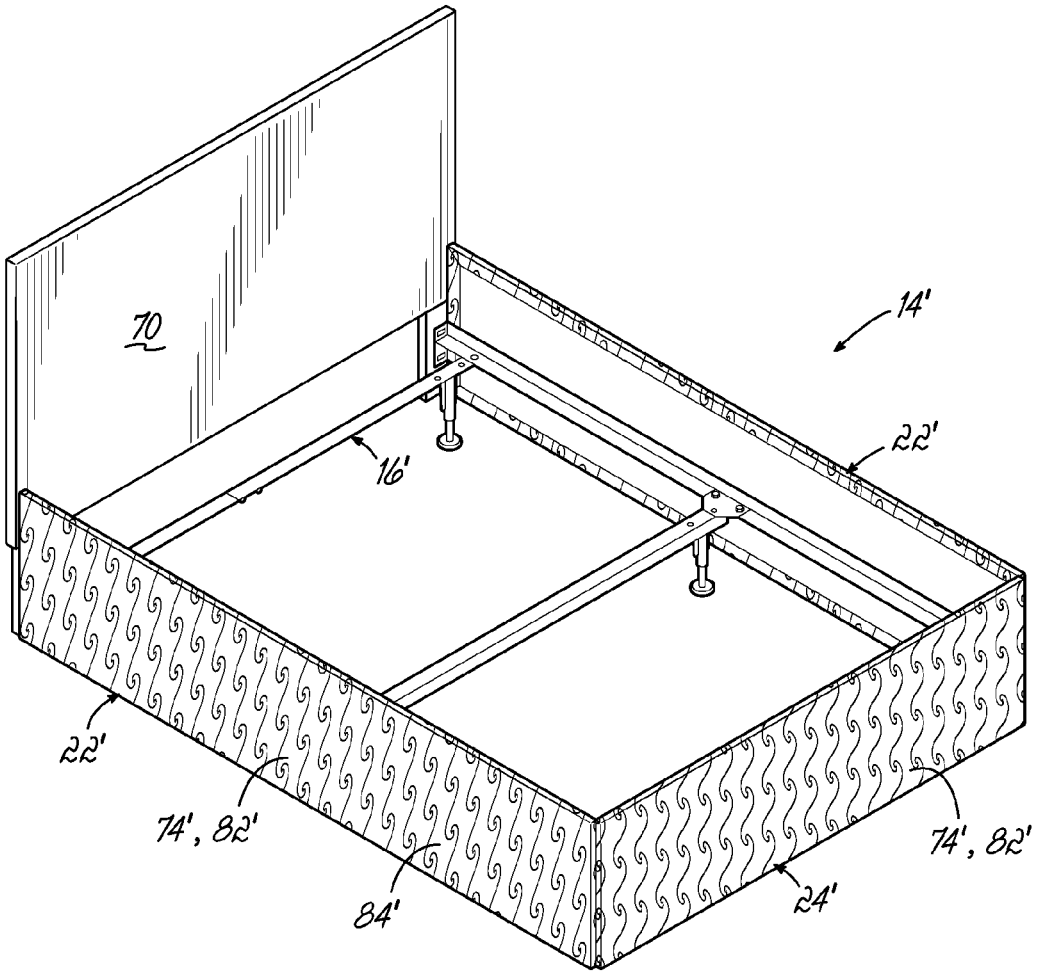
FIG. 4B is a perspective view of a second embodiment of a simulated platform bed panel system in accordance with the principles of the present invention with a bed frame of the bed system of FIG. 1 and the headboard of FIG. 1.

Turning to FIG. 3, the simulated platform bed panel system 14 includes side panels 22 and a foot panel 24. The side panels 22 have a length $l_p$ extending between a head side 54 and a foot side 56, and a height $h_{sp}$ extending between a bottom side 58 and a top side 60. The foot panel has a width $w_p$ extending between a left side 62 and a right side 64 and a height $h_{fp}$ (which is advantageously about the same as the height $h_{sp}$ of the side panels 22) extending between a bottom side 66 and a top side 68. The foot panel 24 generally connects the respective side panels 22 near the foot sides 56 and the left and right sides 62, 64. A headboard 70, if used, is situated opposite the foot panel 24 generally near the head sides 54 of the side panels 22 (FIGS. 1 and 4B). Advantageously, the side panels 22 are substantially identical, and can be flipped so that a head side 54 becomes a foot side 56 and a top side 60 become a bottom side 58, and vice-versa. Similarly, it is advantageous if the foot panel 24 can be flipped so that a left side 62 becomes a right side 64 and a top side 64 becomes a bottom side 62, and vice-versa. The length $l_p$ of the side panels 22 and the width $w_p$ of the foot panel 24 advantageously correspond with, or are approximately equal to, the length $l_m$ and the width $w_m$, respectively, of the mattress 18. In the embodiment shown, the bed frame 16 and mattress 18 are close to the same size in length and width such that the length $l_p$ of the side panels 22 and the width $w_p$ of the foot panel 24 also correspond, or are approximately equal to, the length $l_f$ and the width $w_f$, respectively, of the bed frame 16.

The side panels 22 and the foot panel 24 have a generally rectangular shape and may be generally rigid, and constructed of such materials as wood, engineered wood products including oriented strand board (OSB), plywood, and the like, plastic, foam, cardboard, and any other suitable material. While the panels 22, 24 may be solid, they may alternatively be formed by framework (not shown) defining one or more empty interior regions in order to decrease the weight of each panel.

As seen in FIGS. 1 and 4, and in use, the bottom sides 58, 66 of the panels 22, 24 are generally adjacent the floor surface 52 and the top sides 60, 68 are generally adjacent a portion of the bed system 12, such as astride the bed frame 16 so as to extend up to the mattress 18. For example, the height $h_{sp}$ and $h_{fp}$ of the panels 22, 24 are advantageously selected such that the top sides 60, 68 are situated adjacent the lower surface 40 of the mattress 18, which is held at the height h above the floor surface 52. As a consequence, the panels 22, 24 block access to or cover up the area below the mattress 18, including the bed frame 16 and the foundation 20 as seen in FIG. 1. Alternatively, the height $h_{sp}$ and $h_{fp}$ of the panels 22, 24 may be such that the top sides 60, 68 are situated slightly above the lower surface 40 of the mattress 18. And while it may be aesthetically less desirable, the height $h_{sp}$ and $h_{fp}$ of the panels 22, 24 may also be such that the top sides 60, 68 are situated slightly below the lower surface 40 of the mattress 18.

The panels 22, 24 include an interior aspect 72 and an exterior aspect 74. The panels 22, 24 are cooperable to be situated in a set 76 defining a U-shape, with the side panels 22 defining the legs 78 of the U-shape and the foot panel 24 defining the yoke 80 of the U-shape (FIG. 3). In the U-shaped set 76, the interior aspects 72 face the interior of the U-shape to thus face the bed frame 16 and the foundation 20, and the exterior aspects 74 are visible outwardly of the bed system 12 along the exterior of the U-shape, such that in use the exterior aspects 74 can be seen or touched. The foot sides 56 of the respective side panels 22 are connected with respective left and right sides 62, 64 of the foot panel 24. The U-shaped set 76 is situated about the bed frame 16 with the side panels 22 astride and advantageously adjacent the bed frame 16 extending between the head end 46 and the foot end 48, and the foot panel 24 astride and advantageously adjacent the bed frame 16 and spanning between the side panels 22. In the embodiment shown, at least the top sides 60 of the side panels 22 are free relative to each other. More specifically, and with reference to FIG. 3, in the U-shape set 76 with the bottom sides 58 sitting against the floor surface 52 and before being situated about the bed system 12, the top sides 60 are directed upwardly and have no intervening structure connecting the top sides 60 to each other (although they may be considered connected via the foot panel 24, there is no structure seen in FIG. 3 which might close off or impede exposure of the floor surface 52 from above the U-shape set 76, such that the top sides 60 are considered free relative to one another). The top side 68 of foot panel 24 may also similarly be free relative to the top sides 60 of one or both of side panels 22.

A decorative feature 82 is advantageously provided on the exterior aspects 74 of the side and foot panels 22, 24. For example, the decorative feature 82 can include upholstery 84 on at least the exterior aspects 74 of the panels 22, 24 (although the upholstery 84 could also wrap around and be attached to and even cover the interior aspects 72 as well). The exterior aspects 74 of the panels 22, 24 can include the head sides 54, foot sides 56, bottom sides 58 and tops sides 60 of the side panels 22 and the left side 62, right side 64, bottom side 66, and top side 68 of the foot panel 24, all of which advantageously include or are covered by the decorative feature 82. Although shown in FIGS. 1-4 as being upholstery, the decorative feature 82 can include any aesthetically desirable feature, non-limiting examples of which may include various types of upholstery or other fabric, white vinyl, white faux leather, velvet, or surface finishes such as paint or stain, textures, sculpture, or the like. For example, the decorative feature 82 in FIGS. 1-3 and 4A is one version of upholstery 84 with a specific visual appearance, whereas the decorative feature 82' on the second embodiment of a simulated platform bed panel system 14' in FIG. 4B presents a different visual appearance even though the panels might otherwise be the same in size and shape. Advantageously, the decorative features 82 of the panels 22, 24 are aesthetically identical, or they may differ as long as they are complementary, i.e., aesthetically compatible.

Figure 5:
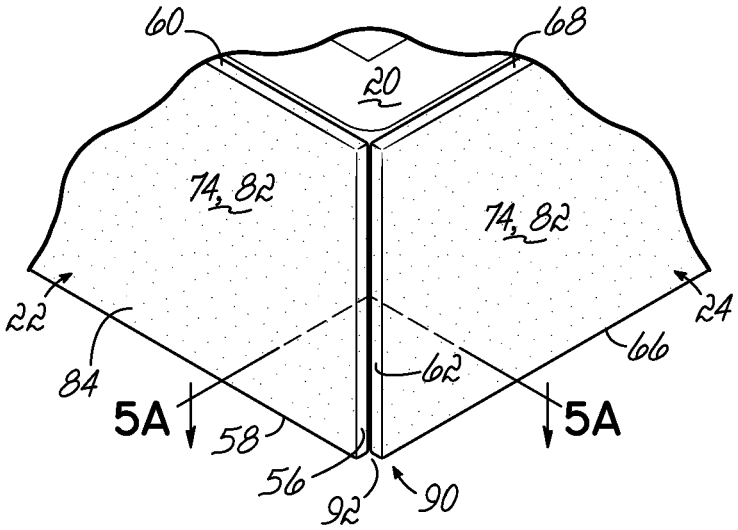
FIG. 5 is a close-up view of the corner junction formed between a side panel and the foot panel of the simulated platform bed panel system of FIG. 1.
Figure 5A:
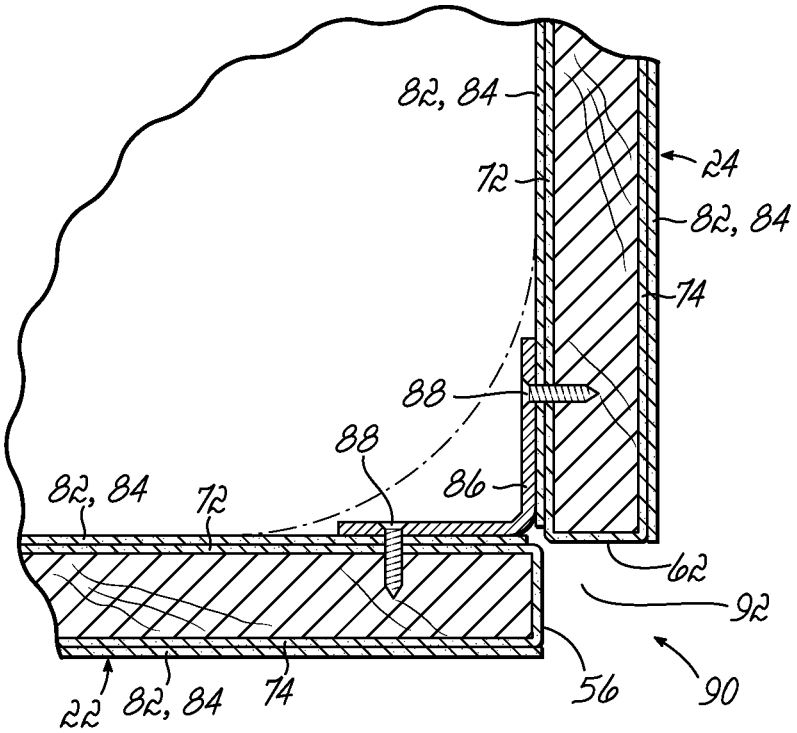
FIG. 5A is a cross-sectional view of the corner junction of FIG. 5 taken along lines 5A-5A.

Turning to FIGS. 5 and 5A, the side panels 22 are connected with the foot panel 24 by one or more brackets 86 (only one shown). The foot sides 56 of each panel 22 are situated adjacent the respective left side 62 and right side 64 of the foot panel 24. Brackets 86 are fastened to each panel 22 and to panel 24 by fasteners 88, which may be any suitable fastener, such as a threaded fastener (a screw is shown), adhesive, a nail, or any other suitable structure. It will be appreciated that the fastener 88 attaches to the interior aspects 72 of panels 22, 24 and should not extend through the entire thickness of the panels 22, 24 so as to not interfere with the decorative feature 82 thereon. As used herein, the term thickness refers to the distance between the interior aspect 72 and the oppositely disposed exterior aspect 74 of the panels 22, 24.

Figure 6:
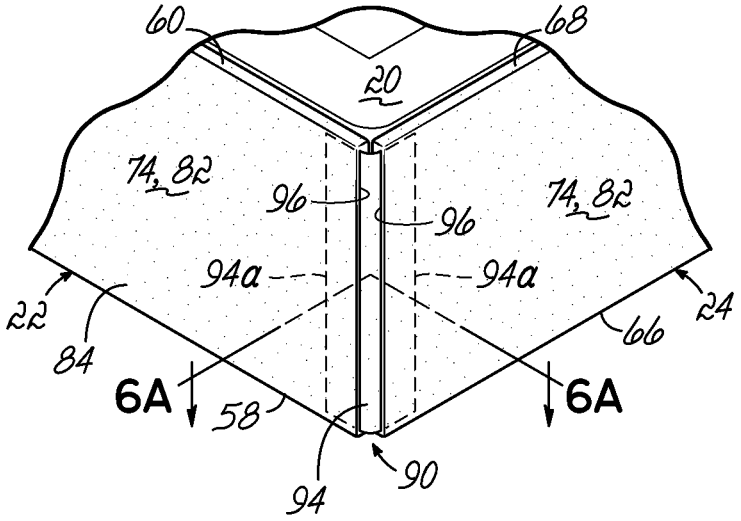
FIG. 6 is a view like FIG. 5 including a corner panel for providing a smooth transition appearance between the side and foot panel in accordance with principles of the present invention.
Figure 6A:
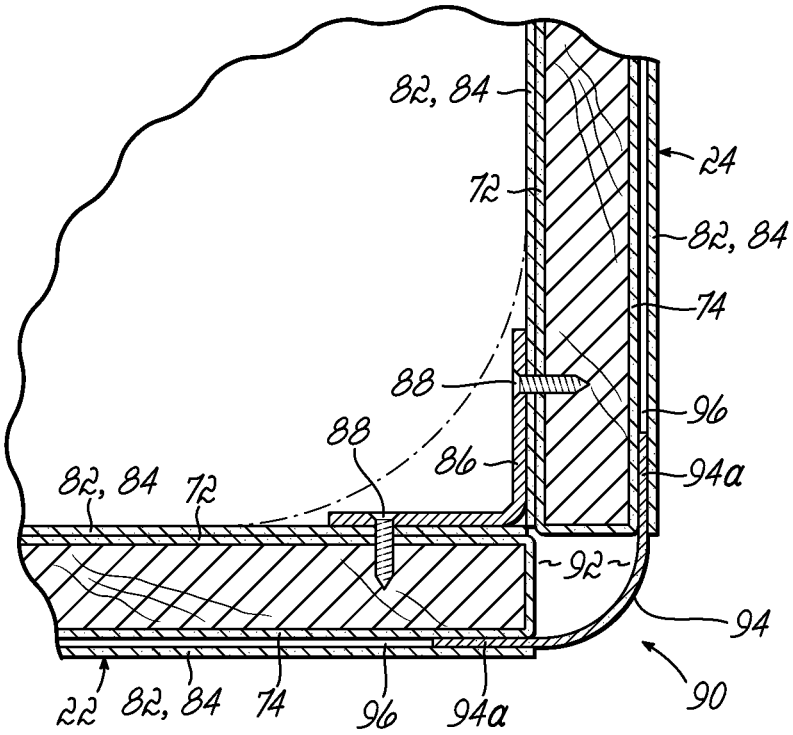
FIG. 6A is a cross-sectional view of the corner junction and corner panel of FIG. 6 taken along lines 6A-6A.

The area where each respective side panel 22 adjoins the foot panel 24 defines a corner junction 90. Because of the thickness of the panels 22, 24, voids 92 are formed between the exterior aspects 74 of adjacent respective panels 22 and 24. And depending on the thickness of the panels, the size of the void 92 may be small or large. To create an appearance of a smooth transition between respective side panels 22 and the foot panel 24, corner panels 94 may be provided at the corner junctions 90 as seen in FIGS. 6 and 6A. The corner panels 94 are generally flexible and are configured to extend between a respective side panel 22 and the foot panel 24. A pocket 96 may be formed in each of side panels 22 and the foot panel 24 near the corner junctions 90. The pockets 96 may be defined by the decorative feature 82, and may be formed, for example, between the exterior aspects 74 of the panels 22, 24 and the decorative feature 82 thereon. For example, where the decorative feature 82 includes upholstery 84, the pockets 96 may be formed between the exterior aspects 74 of the panels 22, 24 and the upholstery 84. Each pocket 96 is configured to receive edge portions 94*a* of the corner panels 94. Thus, and as shown in FIGS. 6 and 6A, the decorative feature 82 on the exterior aspect 74 of the side panel 22 transitions through a smooth and arcuate curve of the corner panel 94 to the decorative feature 82 on the exterior aspect 74 of the foot panel 24. Advantageously, the decorative features 82 of the panels 22, 24 and the corner panels 94 are complementary or are aesthetically identical.

Figure 7:
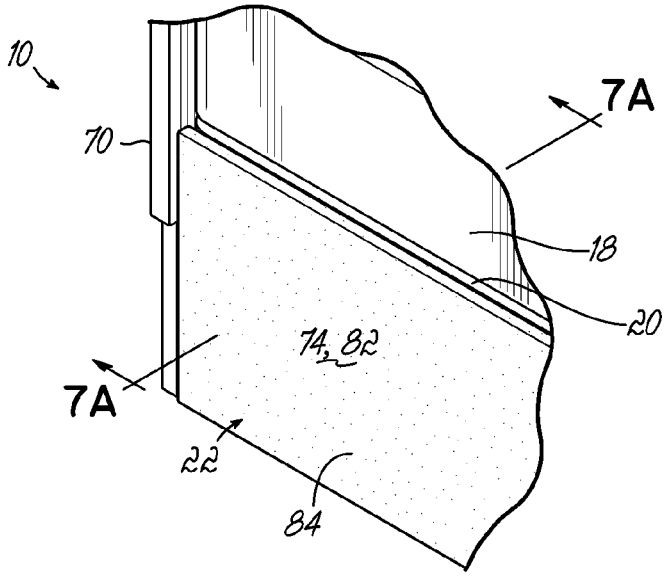
FIG. 7 is a close-up view of a portion of the simulated platform bed of FIG. 1 at the head end thereof.
Figure 7A:
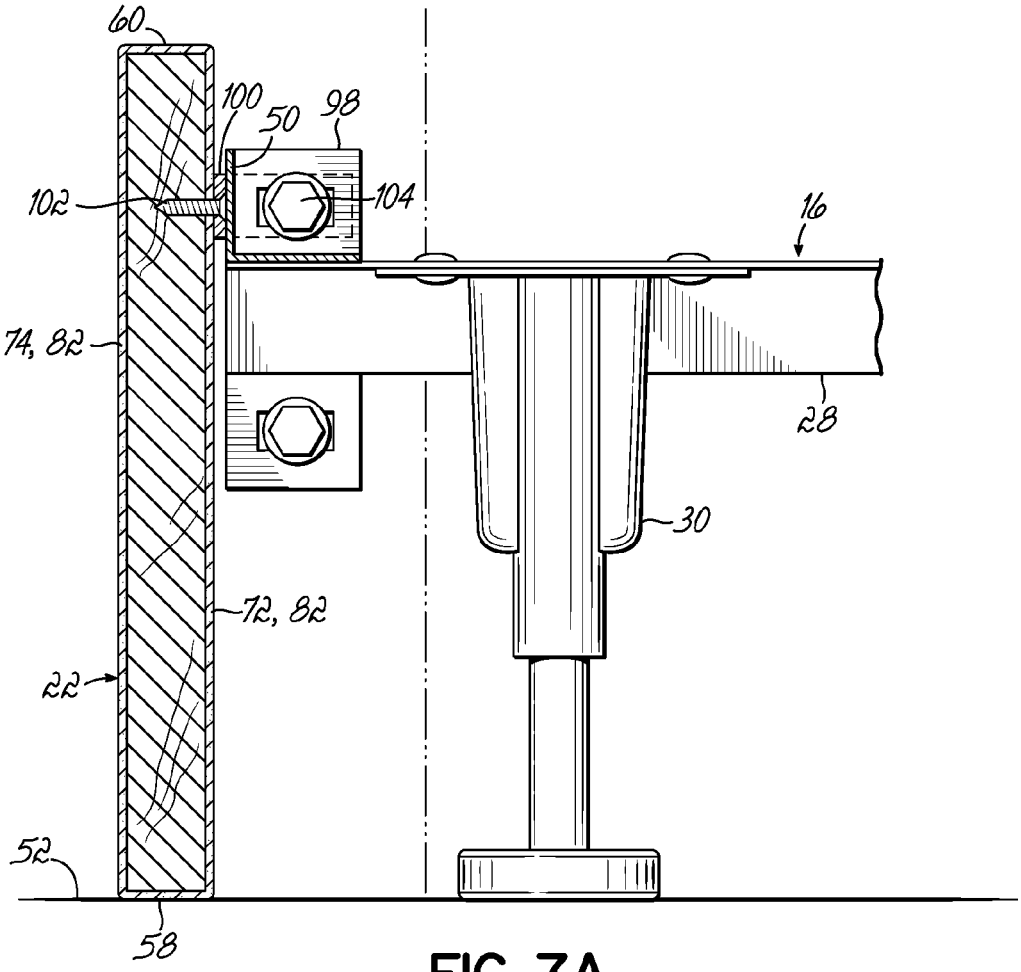
FIG. 7A is a cross-sectional view of the portion of FIG. 7 taken along lines 7A-7A.

Advantageously, the simulated platform bed panel system 14 may be situated in the U-shaped set 76 discussed above and positioned adjacent the bed system 12 or the bed frame 16 without any fastening or attachment between the two. Alternatively, one or more of the panels 22, 24 may be connected to the bed frame 16 and any of the panels 22, 24 may be configured therefor. As best seen in FIG. 7, the bed frame 16 includes a mounting flange 98 located at the head end 46 of a lengthwise extending rail 26. The mounting flange 98 is useful for attaching the bed frame 16 to a headboard (such as headboard 70), a wall surface, or another structure. A mounting bracket 100 can be used to connect any of panels 22, 24 to the bed frame 16. As shown in FIG. 7A, a right-angle mounting bracket 100 (which could be the same as the brackets 86 used to connect the panels 22, 24) is attached to side panel 22 by a fastener 102 extending into the thickness of the side panel 22. Another fastener 104 connects the mounting bracket 100 to the mounting flange 98. The mounting bracket 100 thereby connects the side panel 22 to the bed frame 16.

Figure 8:
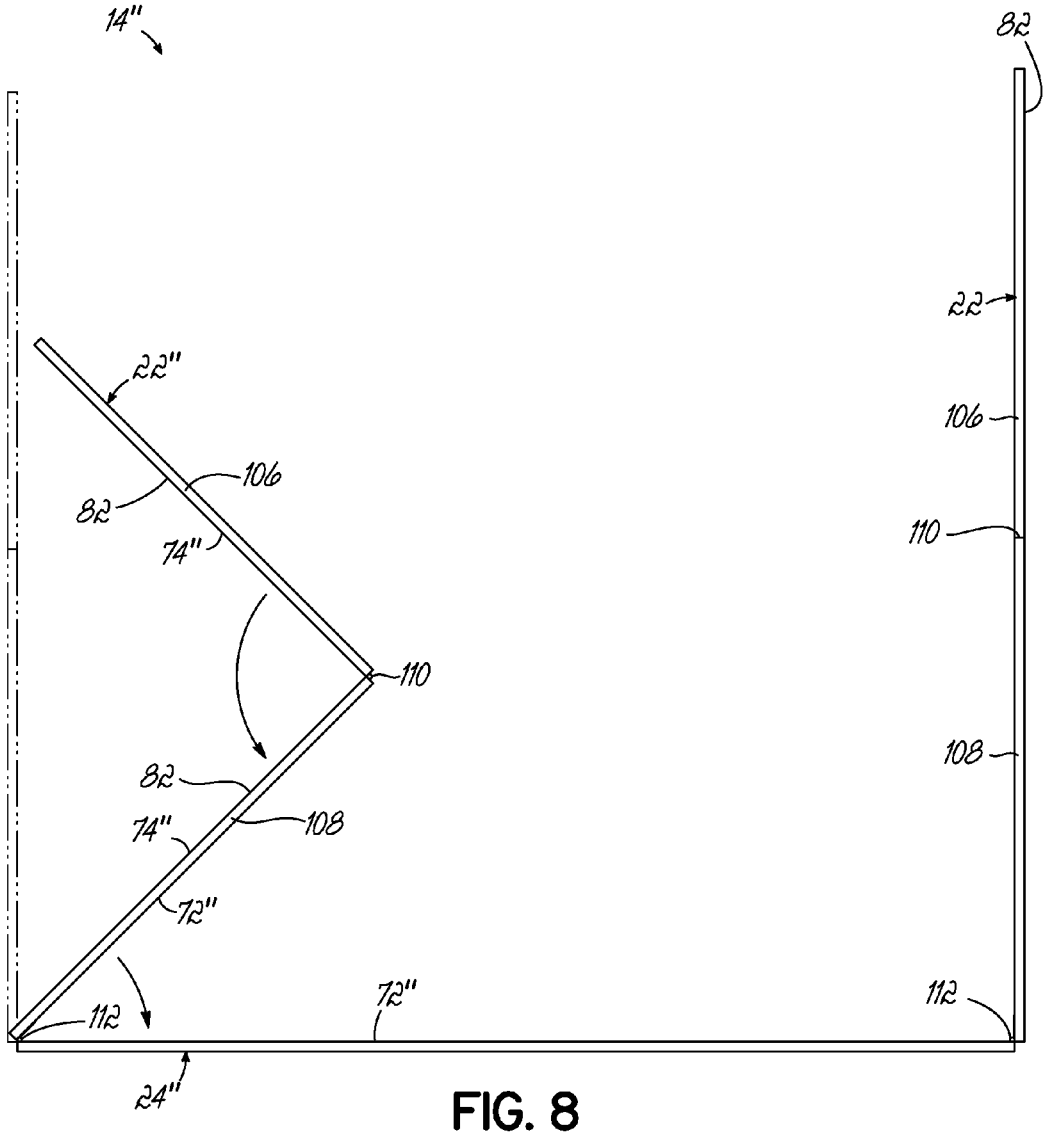
FIG. 8 is a top plan view of a third embodiment of a simulated platform bed panel system, with the side panels including first and second segments hingedly connected together and the second segments hingedly connected with the foot panel.
Figure 9:
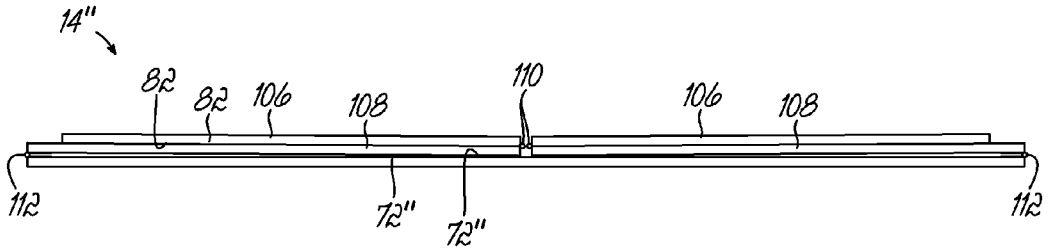
FIG. 9 is a top plan view of the panels of FIG. 8 in a folded arrangement.

Turning to FIGS. 8 and 9, a third embodiment of a simulated platform bed panel system is shown at 14". Either or both of the side panels 22" includes two or more segments 106, 108 hingedly connected together. For example, and as shown, each of the side panels 22" includes a first segment 106 and a second segment 108, of roughly equal length, that are connected by a hinge 110. The hinge 110 is advantageously associated with the interior aspect 72" of the panels 22" so as not to mar or protrude into or beyond the decorative feature 82 associated with the exterior aspect 74" thereof. Also, the second segments 108 are connected to the foot panel 24" by a hinge 112. Thus, as shown in FIG. 9, when the first and second segments 106, 108 are folded at the hinge 110, their exterior aspects 74" are in confronting relationship with each other. And when the second segments 108 are folded at the hinge 112 with the foot panel 24", the interior aspects 72" of the foot panel 24" and the second segments 108 are in confronting relationship with each other.

As a result, the simulated platform bed panel system 14" may be very compact for shipping purposes, and then unfolded on site for use in a simulated platform bed 10. The segments may be held in the unfolded state by locking elements associated with the hinges 110 and/or the interior aspects 72" of the segments. Optionally, the side panels may be hingedly connected to the foot panel, even where each side panel includes only one segment. In addition, the foot panel may include two or more segments hingedly connected together (not shown). The segments 106, 108 may be rigid such that when unfolded, the panels 22" and/or 24" are considered rigid.

A framing kit can be provided for use with a bed system having at least a bed frame and a mattress so that a user can assemble the framing kit into a simulated platform bed panel system and use it with the bed system as disclosed herein. In particular, such a framing kit includes the components of the simulated platform bed panel system 14, including the side panels 22 and the foot panel 24, as well as the brackets 86, 100 and fasteners 88, 102, and 104 used to connect the panels 22, 24 to each other as well as to the bed system. A framing kit may advantageously also include the corner panels 94.

In use, the simulated platform bed panel system 14 adds a decorative aspect to a bed system to simulate a platform bed system. To that end, the side panels 22 and the foot panel 24 are positioned astride, and possibly adjacent to, a mattress support 16 in a U-shaped set 76 (if any of the panels 22, 24 include segments hingedly connected together, those segments are unfolded) with the decorative feature 82 of each panel 22, 24 directed outwardly. The simulated platform bed panel system 14 may also be connected to the bed system 12. Further advantageously, corner panels 94 are installed at the corner junctions 90 formed by the side panels 22 and the foot panel 24. In some circumstances, the simulated platform bed panel system 14 may be assembled into the set 76 away from the bed system 12 and then moved into a position astride the bed frame 16. An exemplary simulated platform bed panel system 14 for a bed system 12 having a king size mattress 18 includes side panels 22 each having a length $l_p$ of about 80 inches and a height $h_{sp}$ of about 17 inches and a foot panel 24 having a width $w_p$ of about 74 inches and a height $h_{fp}$ of about 17 inches, inclusive of decorative features 82.

By virtue of the foregoing, there is thus provided a simulated platform bed panel system useable with a bed system to provide the appearance that a mattress of the bed system is supported by a platform bed.

While the present invention has been illustrated by the description of embodiments thereof, and while the embodiments have been described in considerable detail, it is not intended to restrict or in any way limit the scope of the appended claims to such detail. Additional advantages and modifications will readily appear to those skilled in the art. For example, the bed frame 16 described herein is merely exemplary, and the simulated platform bed panel system of the present invention may be used with bed frames or other mattress supports having other configurations, as well. In that regard, where a mattress is supported above multiple bed frames, such as in the case of a large, so-called California King mattress being supported above two twin bed frames, the simulated platform bed panel system can be configured so as to fit around the two twin frames. Moreover, the simulated platform bed panel system could also be placed around an existing furniture-style bed system or a platform bed system, as each includes a mattress supported above the floor surface by a mattress support. Placing a simulated platform bed panel system around an existing furniture-style or platform bed system may be advantageous if the bed system is aesthetically undesirable or simply if a change of style is preferred. And while the panels 22, 24 are shown and described as being astride the bed frame 16 and adjacent at least the side rails 26, the position of the panels of the simulated platform bed panel system with respect to a bed frame may vary depending on the bed frame. In some circumstances, the panels may be spaced from the bed frame, although still considered astride the frame. By way of example, where the length of the bed frame is smaller than the length of the foundation and/or mattress, the foot panel will be astride the foot end of the frame, but may be spaced away so as not to be considered adjacent. Appropriate lengths, widths, and heights of the panels of the simulated platform bed systems will be apparent to those of ordinary skill. Also, multiple brackets may be used to connect the foot panel to each side panel, and also to connect the panels to the mattress support. Similarly, other attachment mechanisms may be employed non-limiting examples of which are bolts, clips, glue or similar adhesives, hook-and-loop fasteners, and magnetic strips. Similarly, although less advantageous, in some embodiments, the top sides 60 of the side panels 22 may be connected to each other and/or to the top side 68 of the foot panel 24 across the exposed area therebetween. The invention in its broader aspects is, therefore, not limited to the specific detail, representative apparatus and methods and illustrative examples shown and described. Accordingly, departures may be made from such details without departing from the spirit or scope of the general inventive concept.

Having described the invention, what is claimed is:

1. A simulated platform bed panel system for use with a bed system having a mattress support adapted independently of the simulated platform bed panel system to support a lower surface of a bed mattress above a floor surface at a first height, said mattress having a first length between ends and a first width between sides, said mattress support having a head end and a foot end, the simulated platform bed panel system comprising:

first and second generally rectangular and rigid side panels each having a length between a head side and a foot side approximately equal to said first length and a height between a top side and a bottom side approximately equal to said first height;

a generally rectangular and rigid foot panel having a width between a left side and a right side approximately equal to said first width and a height between a top side and a bottom side approximately equal to said first height;

each of the panels having an exterior aspect having a decorative feature;

the panels being cooperable to be situated in a set defining a U-shape with the exterior aspects thereof directed outwardly, the side panels defining the legs and the foot panel defining the yoke of the U-shape such that the set can be situated about and generally independent from said mattress support with the side panels adjacent said mattress support extending between said head end and said foot end and the foot panel adjacent said foot end spanning between the first and second side panels so as to create the appearance of a platform bed upon which said mattress appears to be supported.

2. The simulated platform bed panel system of claim 1, the foot sides of each side panel being connected with respective left and right sides of the foot panel.

3. The simulated platform bed panel system of claim 1 further comprising a bracket connecting respective foot sides of the respective side panels with respective left and right sides of the foot panel.

4. The simulated platform bed panel system of claim 1, at least one of the panels being configured to be attached to said mattress support.

5. The simulated platform bed panel system of claim 4 wherein said mattress support includes a bed frame adapted to support a foundation on which said mattress is to be supported, the simulated platform bed panel system further comprising a bracket configured to attach one of the side panels to said bed frame.

6. The simulated platform bed panel system of claim 1, the foot end of at least one of the side panels being hingedly attached to the foot panel at one of the left and right sides thereof.

7. The simulated platform bed panel system of claim 1, the foot end of each of the side panels being hingedly attached to respective left and right sides of the foot panel.

8. The simulated platform bed panel system of claim 7, each of the side panels including a first segment and a second segment, the first and second segments being hingedly attached to one another.

9. The simulated platform bed panel system of claim 1, each of the side panels including a first segment and a second segment, the first and second segments being hingedly attached to one another.

10. The simulated platform bed panel system of claim 1, wherein each side panel adjoins the foot panel to define a corner junction, the simulated platform bed panel system further comprising a pair of generally flexible corner panels each configured to extend between a respective one of the side panels and the foot panel at the corner junctions whereby to provide a smooth transition appearance thereat.

11. The simulated platform bed panel system of claim 10, the side panels and the foot panel each including a pocket at the corner junction sized to receive therein respective edge portions of respective one of the corner panels.

12. The simulated platform bed panel system of claim 11, the corner panels each having an exterior aspect with a decorative feature.

13. The simulated platform bed panel system of claim 12, the respective pockets being defined by the decorative feature of the respective panel.

14. The simulated platform bed panel system of claim 13, the respective pockets being defined between the decorative feature of the respective panel and the respective panel.

15. The simulated platform bed panel system of claim 12, the decorative features of the corner panels, the side panels, and the foot panel, being complementary.

16. The simulated platform bed panel system of claim 12, the decorative features of the corner panels, the side panels, and the foot panel, being aesthetically identical.

17. The simulated platform bed panel system of claim 12, the decorative features of the corner panels, the side panels, and the foot panel, being selected respectively from the group consisting essentially of upholstery, paint, stain, texture, and sculpture, and combinations thereof.

18. The simulated platform bed panel system of claim 10, the corner panels each having an exterior aspect with a decorative feature.

19. The simulated platform bed panel system of claim 18, the decorative features of the corner panels, the side panels, and the foot panel, being complementary.

20. The simulated platform bed panel system of claim 18, the decorative features of the corner panels, side panels, and foot panels, being aesthetically identical.

21. The simulated platform bed panel system of claim 18, the decorative features of the corner panels, the side panels, and the foot panel, being selected respectively from the group consisting essentially of upholstery, paint, stain, texture, and sculpture, and combinations thereof.

22. The simulated platform bed panel system of claim 1, the decorative features of the side panels and the foot panel being complementary.

23. The simulated platform bed panel system of claim 1, the decorative features of the side panels and the foot panels being aesthetically identical.

24. The simulated platform bed panel system of claim 1, the decorative features of the side panels and the foot panel being selected respectively from the group consisting essentially of upholstery, paint, stain, texture, and sculpture, and combinations thereof.

25. The simulated platform bed panel system of claim 1, the decorative feature of each panel including upholstery extending at least from the top side to the bottom side.

26. The simulated platform bed panel system of claim 1, the decorative feature of each side panel extends substantially completely between the head side and the foot side, and the decorative feature of the foot panel extends substantially completely between the left side and the right side.

27. The simulated platform bed panel system of claim 1 wherein said mattress support includes a bed frame and a foundation supported by said bed frame and adapted to support said mattress thereon, the height of said panels being such as to extend to at least a top of said foundation.

28. The simulated platform bed panel system of claim 1, the height of said panels being slightly greater than said first height so as to extend slightly above a bottom edge of said mattress.

29. A simulated platform bed, comprising, in combination:

a bed system comprising a mattress and a mattress support adapted to support a lower surface of the mattress above a floor surface at a first height, the mattress having a first length between ends and a first width between sides, the mattress support having a head end and a foot end, and a simulated platform bed panel system comprising first and second generally rectangular and rigid side panels each having a length between a head side and a foot side approximately equal to the first length and a height between a top side and a bottom side approximately equal to the first height, and a generally rectangular and rigid foot panel having a width between a left side and a right side approximately equal to the first width and a height between a top side and a bottom side approximately equal to the first height, each of the panels having an exterior aspect having a decorative feature, the panels being situated in a set defining a U-shape with the exterior aspects thereof directed outwardly, the side panels defining the legs and the foot panel defining the yoke of the U-shape, and being situated about and generally independent from said mattress support with the side panels adjacent the mattress support extending between the head end and the foot end and the foot panel adjacent the foot end spanning between the first and second side panels so as to create the appearance of a platform bed upon which the mattress appears to be supported, wherein the mattress support of the bed system supports the mattress independently of the simulated platform bed panel system.

30. The simulated platform bed of claim 29, the foot sides of each side panel being connected with respective left and right sides of the foot panel.

31. The simulated platform bed of claim 29 further comprising a bracket connecting respective foot sides of the respective side panels with respective left and right sides of the foot panel.

32. The simulated platform bed of claim 29, at least one of the panels being configured to be attached to the mattress support.

33. The simulated platform bed of claim 32 wherein the mattress support includes a bed frame adapted to support a foundation on which the mattress is to be supported, the simulated platform bed panel system further comprising a bracket configured to attach one of the side panels to the bed frame.

34. The simulated platform bed of claim 29, the foot end of at least one of the side panels being hingedly attached to the foot panel at one of the left and right sides thereof.

35. The simulated platform bed of claim 29, the foot end of each of the side panels being hingedly attached to respective left and right sides of the foot panel.

36. The simulated platform bed of claim 35, each of the side panels including a first segment and a second segment, the first and second segments being hingedly attached to one another.

37. The simulated platform bed of claim 29, each of the side panels including a first segment and a second segment, the first and second segments being hingedly attached to one another.

38. The simulated platform bed of claim 29, wherein each side panel adjoins the foot panel to define a corner junction, the simulated platform bed further comprising a pair of generally flexible corner panels each configured to extend between a respective one of the side panels and the foot panel at the corner junctions whereby to provide a smooth transition appearance thereat.

39. The simulated platform bed of claim 38, the side panels and the foot panel each including a pocket at the corner junction sized to receive therein respective edge portions of respective one of the corner panels.

40. The simulated platform bed of claim 39, the corner panels each having an exterior aspect with a decorative feature.

41. The simulated platform bed of claim 40, the respective pockets being defined by the decorative feature of the respective panel.

42. The simulated platform bed of claim 41, the respective pockets being defined between the decorative feature of the respective panel and the respective panel.

43. The simulated platform bed of claim 40, the decorative features of the corner panels, the side panels, and the foot panel, being complementary.

44. The simulated platform bed of claim 40, the decorative features of the corner panels, the side panels, and the foot panel, being aesthetically identical.

45. The simulated platform bed of claim 40, the decorative features of the corner panels, the side panels, and the foot panel, being selected respectively from the group consisting essentially of upholstery, paint, stain, texture, and sculpture, and combinations thereof.

46. The simulated platform bed of claim 38, the corner panels each having an exterior aspect with a decorative feature.

47. The simulated platform bed of claim 46, the decorative features of the corner panels, the side panels, and the foot panel, being complementary.

48. The simulated platform bed of claim 46, the decorative features of the corner panels, side panels, and foot panels, being aesthetically identical.

49. The simulated platform bed of claim 46, the decorative features of the corner panels, the side panels, and the foot panel, being selected respectively from the group consisting essentially of upholstery, paint, stain, texture, and sculpture, and combinations thereof.

50. The simulated platform bed of claim 29, the decorative features of the side panels and the foot panel being complementary.

51. The simulated platform bed of claim 29, the decorative features of the side panels and the foot panels being aesthetically identical.

52. The simulated platform bed of claim 29, the decorative features of the side panels and the foot panel being selected respectively from the group consisting essentially of upholstery, paint, stain, texture, and sculpture, and combinations thereof.

53. The simulated platform bed of claim 29, the decorative feature of each panel including upholstery extending at least from the top side to the bottom side.

54. The simulated platform bed of claim 29, the decorative feature of each side panel extends substantially completely between the head side and the foot side, and the decorative feature of the foot panel extends substantially completely between the left side and the right side.

55. The simulated platform bed of claim 29 wherein the mattress support includes a bed frame and a foundation supported by the bed frame, the mattress is supported on the foundation, and the height of the panels is such as to extend to at least a top of the foundation.

56. The simulated platform bed of claim 29, the height of the panels being slightly greater than the first height so as to extend slightly above a bottom edge of the mattress.

57. A framing kit for use with a bed system having a mattress support and a mattress, said mattress support adapted to support a lower surface of said mattress above a floor surface at a first height, said mattress having a first length between ends and a first width between sides, said mattress support having a head end and a foot end, the framing kit comprising:

first and second generally rectangular and rigid side panels each having a length between a head side and a foot side approximately equal to said first length and a height between a top side and a bottom side approximately equal to said first height;

a generally rectangular and rigid foot panel having a width between a left side and a right side approximately equal to said first width and a height between a top side and a bottom side approximately equal to said first height;

each of the panels having an exterior aspect having a decorative feature; and a plurality of brackets, the panels being cooperable to be situated in a set defining a U-shape with the exterior aspects thereof directed outwardly, the side panels defining the legs and the foot panel defining the yoke of the U-shape such that the set can be situated about and generally independent from said mattress support with the side panels adjacent said mattress support extending between said head end and said foot end and the foot panel adjacent said foot end spanning between the first and second side panels so as to create the appearance of a platform bed upon which said mattress appears to be supported, and the brackets being adapted to secure the side panels to the foot panel and/or secure at least one of the panels to said mattress support, wherein the mattress support of the bed system supports the mattress independently of the panels of the framing kit.

58. A simulated platform bed panel system for use with a bed system having a mattress support adapted independently of the simulated platform bed panel system to support a lower surface of a bed mattress above a floor surface at a first height, said mattress having a first length between ends and a first width between sides, said mattress support having a head end and a foot end, the simulated platform bed panel system comprising:

first and second generally rectangular and rigid side panels each having a length between a head side and a foot side approximately equal to said first length and a height between a top side and a bottom side approximately equal to said first height, a pocket defined in the side panels adjacent the foot sides thereof;

a generally rectangular and rigid foot panel having a width between a left side and a right side approximately equal to said first width and a height between a top side and a bottom side approximately equal to said first height, pockets defined in the foot panel adjacent the left and right sides thereof;

generally flexible corner panels extending between respective pockets in the side panels and the pockets in the foot panel for providing a smooth transition between the side panels and the foot panel;

each of the side panels, the foot panel, and the corner panels having an exterior aspect having a decorative feature; the respective pockets being defined between the decorative feature of the respective panel and the respective panel, the panels being cooperable to be situated in a set defining a U-shape with the exterior aspects thereof directed outwardly, the side panels defining the legs and the foot panel defining the yoke of the U-shape such that the set can be situated about and generally independent from said mattress support with the side panels adjacent said mattress support extending between said head end and said foot end and the foot panel adjacent said foot end spanning between the first and second side panels so as to create the appearance of a platform bed upon which said mattress appears to be supported.

59. A simulated platform bed panel system for use with a bed system having a mattress support adapted independently of the simulated platform bed panel system to support a lower surface of a bed mattress above a floor surface at a first height, said mattress having a first length between ends and a first width between sides, said mattress support having a head end and a foot end, the simulated platform bed panel system comprising:

first and second generally rectangular side panels each having a length between a head side and a foot side approximately equal to said first length and a height between a top side and a bottom side approximately equal to said first height;

a generally rectangular foot panel having a width between a left side and a right side approximately equal to said first width and a height between a top side and a bottom side approximately equal to said first height;

each of the panels having an exterior aspect having a decorative feature;

the panels being cooperable to be situated in a set defining a U-shape with the exterior aspects thereof directed outwardly and the top sides directed upwardly, the top sides of the side panels being free relative to each other, the side panels defining the legs and the foot panel defining the yoke of the U-shape such that the set can be situated about and generally independent from said mattress support with the side panels adjacent said mattress support extending between said head end and said foot end and the foot panel adjacent said foot end spanning between the first and second side panels so as to create the appearance of a platform bed upon which said mattress appears to be supported.

60. A simulated platform bed, comprising, in combination:

a bed system comprising a mattress and a mattress support adapted to support a lower surface of the mattress above a floor surface at a first height, the mattress having a first length between ends and a first width between sides, the mattress support having a head end and a foot end, and a simulated platform bed panel system comprising first and second generally rectangular side panels each having a length between a head side and a foot side approximately equal to the first length and a height between a top side and a bottom side approximately equal to the first height, and a generally rectangular foot panel having a width between a left side and a right side approximately equal to the first width and a height between a top side and a bottom side approximately equal to the first height, each of the panels having an exterior aspect having a decorative feature, and the panels being situated in a set defining a U-shape with the exterior aspects thereof directed outwardly and the top sides directed upwardly, the top sides of the side panels being free relative to each other, the side panels defining the legs and the foot panel defining the yoke of the U-shape, and being situated about and generally independent from the mattress support with the side panels adjacent the mattress support extending between the head end and the foot end and the foot panel adjacent the foot end spanning between the first and second side panels so as to create the appearance of a platform bed upon which the mattress appears to be supported, wherein the mattress support of the bed system supports the mattress independently of the simulated platform bed panel system.

61. A framing kit for use with a bed system having a mattress support and a mattress, said mattress support adapted to support a lower surface of said mattress above a floor surface at a first height, said mattress having a first length between ends and a first width between sides, said mattress support having a head end and a foot end, the framing kit comprising:

first and second generally rectangular side panels each having a length between a head side and a foot side approximately equal to said first length and a height between a top side and a bottom side approximately equal to said first height;

a generally rectangular foot panel having a width between a left side and a right side approximately equal to said first width and a height between a top side and a bottom side approximately equal to said first height;

each of the panels having an exterior aspect having a decorative feature; and a plurality of brackets, the panels being cooperable to be situated in a set defining a U-shape with the exterior aspects thereof directed outwardly and the top sides directed upwardly with the top sides of the side panels being free relative to each other, the side panels defining the legs and the foot panel defining the yoke of the U-shape such that the set can be situated about and generally independent from said mattress support with the side panels adjacent said mattress support extending between said head end and said foot end and the foot panel adjacent said foot end spanning between the first and second side panels so as to create the appearance of a platform bed upon which said mattress appears to be supported, and the brackets being adapted to secure the side panels to the foot panel and/or secure at least one of the panels to said mattress support, wherein the mattress support of the bed system supports the mattress independently of the panels of the framing kit.

62. A simulated platform bed panel system for use with a bed system having a mattress support adapted independently of the simulated platform bed panel system to support a lower surface of a bed mattress above a floor surface at a first height, said mattress having a first length between ends and a first width between sides, said mattress support having a head end and a foot end, the simulated platform bed panel system comprising:

first and second generally rectangular side panels each having a length between a head side and a foot side approximately equal to said first length and a height between a top side and a bottom side approximately equal to said first height, a pocket defined in the side panels adjacent the foot sides thereof;

a generally rectangular foot panel having a width between a left side and a right side approximately equal to said first width and a height between a top side and a bottom side approximately equal to said first height, pockets defined in the foot panel adjacent the left and right sides thereof;

generally flexible corner panels extending between respective pockets in the side panels and the pockets in the foot panel for providing a smooth transition between the side panels and the foot panel;

each of the side panels, the foot panel, and the corner panels having an exterior aspect having a decorative feature; the respective pockets being defined between the decorative feature of the respective panel and the respective panel, the panels being cooperable to be situated in a set defining a U-shape with the exterior aspects thereof directed outwardly and the top sides directed upwardly with the top sides of the side panels being free relative to each other, the side panels defining the legs and the foot panel defining the yoke of the U-shape such that the set can be situated about and generally independent from said mattress support with the side panels adjacent said mattress support extending between said head end and said foot end and the foot panel adjacent said foot end spanning between the first and second side panels so as to create the appearance of a platform bed upon which said mattress appears to be supported.

63. The simulated platform bed panel system of claim 59, the top side of the foot panel being free relative to the side panels.

64. The simulated platform bed of claim 60, the top side of the foot panel being free relative to the side panels.

65. The framing kit of claim 61, the top side of the foot panel being free relative to the side panels.

66. The simulated platform bed panel system of claim 62, the top side of the foot panel being free relative to the side panels.

67. The simulated platform bed panel system of claim 1, the top side and bottom side of the first side panel extending along the entire length thereof and being generally parallel with one another and the top side and bottom side of the second side panel extending along the entire length thereof and being generally parallel with one another.

68. The simulated platform bed panel system of claim 1, the top side and bottom side of the foot panel extending along the entire width thereof and being generally parallel with one another.

69. The simulated platform bed panel system of claim 1, the bottom side of the first side panel having a portion adjacent the head side and a portion adjacent the foot side, each of the portions of the first side panel bottom side being configured for lying adjacent the floor surface, and the bottom side of the second side panel having a portion adjacent the head side and a portion adjacent the foot side, each of the portions of the second side panel bottom side being configured for lying adjacent the floor surface.

70. The simulated platform bed panel system of claim 69, the bottom side of each of the first side panel and the second side panel further including an intermediate portion interconnecting the portion adjacent the head side and the portion adjacent the foot side.

71. The simulate platform bed panel system of claim 70, the intermediate portion of the bottom side of each of the first side panel and the second side panel also being configured for lying adjacent the floor surface.

72. The simulated platform bed panel system of claim 1, the bottom side of the foot panel having a portion adjacent the left side and a portion adjacent the right side, each of the portions of the foot panel bottom side being configured for lying adjacent the floor surface.

73. The simulated platform bed panel system of claim 72, the bottom side of the foot panel further including an intermediate portion interconnecting the portion adjacent the left side and the portion adjacent the right side.

74. The simulated platform bed panel system of claim 73, the intermediate portion also being configured for lying adjacent the floor surface.

75. The simulated platform bed panel system of claim 1, each of the panels including a framework.

76. The simulated platform bed panel system of claim 75, each framework defining at least one empty interior region.

77. The simulated platform bed panel system of claim 1, each of the panels including at least one empty interior region.

78. The simulated platform bed panel system of claim 1, each of the panels being a solid panel.

79. The simulated platform bed of claim 29, the top side and bottom side of the first side panel extending along the entire length thereof and being generally parallel with one another and the top side and bottom side of the second side panel extending along the entire length thereof and being generally parallel with one another.

80. The simulated platform bed of claim 29, the top side and bottom side of the foot panel extending along the entire width thereof and being generally parallel with one another.

81. The simulated platform bed of claim 29, the bottom side of the first side panel having a portion adjacent the head side and a portion adjacent the foot side, each of the portions of the first side panel bottom side being configured for lying adjacent the floor surface, and the bottom side of the second side panel having a portion adjacent the head side and a portion adjacent the foot side, each of the portions of the second side panel bottom side being configured for lying adjacent the floor surface.

82. The simulated platform bed of claim 81, the bottom side of each of the first side panel and the second side panel further including an intermediate portion interconnecting the portion adjacent the head side and the portion adjacent the foot side.

83. The simulate platform bed of claim 82, the intermediate portion of the bottom side of each of the first side panel and the second side panel also being configured for lying adjacent the floor surface.

84. The simulated platform bed of claim 29, the bottom side of the foot panel having a portion adjacent the left side and a portion adjacent the right side, each of the portions of the foot panel bottom side being configured for lying adjacent the floor surface.

85. The simulated platform bed of claim 84, the bottom side of the foot panel further including an intermediate portion interconnecting the portion adjacent the left side and the portion adjacent the right side.

86. The simulated platform bed of claim 85, the intermediate portion also being configured for lying adjacent the floor surface.

87. The simulated platform bed of claim 29, each of the panels including a framework.

88. The simulated platform bed of claim 87, each framework defining at least one empty interior region.

89. The simulated platform bed of claim 29, each of the panels including at least one empty interior region.

90. The simulated platform bed of claim 29, each of the panels being a solid panel.

91. The framing kit of claim 57, the top side and bottom side of the first side panel extending along the entire length thereof and being generally parallel with one another, the top side and bottom side of the second side panel extending along the entire length thereof and being generally parallel with one another, and the top side and bottom side of the foot panel extending along the entire width thereof and being generally parallel with one another.

92. The framing kit of claim 57, the bottom side of the first side panel having a portion adjacent the head side and a portion adjacent the foot side, each of the portions of the first side panel bottom side being configured for lying adjacent the floor surface, and the bottom side of the second side panel having a portion adjacent the head side and a portion adjacent the foot side, each of the portions of the second side panel bottom side being configured for lying adjacent the floor surface, the bottom side of the foot panel having a portion adjacent the left side and a portion adjacent the right side, each of the portions of the bottom side of each of the first side panel, the second side panel, and the foot panel being configured for lying adjacent the floor surface, the bottom side of each of the first side panel and the second side panel further including an intermediate portion interconnecting the portion adjacent the head side and the portion adjacent the foot side, and the bottom side of the foot panel further including an intermediate portion interconnecting the portion adjacent the left side and the portion adjacent the right side.

93. The framing kit of claim 92, the intermediate portion of the bottom side of each of the first side panel, the second side panel, and the foot panel also being configured for lying adjacent the floor surface.

94. A simulated platform bed, comprising, in combination:

a bed system comprising a mattress and a mattress support adapted to support a lower surface of the mattress above a floor surface at a first height, the mattress having a first length between ends and a first width between sides, the mattress support having a head end and a foot end, and a simulated platform bed panel system comprising first and second side panels each having a length between a head side and a foot side approximately equal to the first length and a height between a top side and a bottom side approximately equal to the first height, and a foot panel having a width between a left side and a right side approximately equal to the first width and a height between a top side and a bottom side approximately equal to the first height, each of the panels having an exterior aspect having a decorative feature, the panels being situated in a set defining a U-shape with the exterior aspects thereof directed outwardly, the side panels defining the legs and the foot panel defining the yoke of the U-shape, and being situated about and generally independent from the mattress support with the side panels adjacent the mattress support extending between the head end and the foot end and the foot panel adjacent the foot end spanning between the first and second side panels so as to create the appearance of a platform bed upon which the mattress appears to be supported, wherein the mattress support of the bed system supports the mattress independently of the simulated platform bed panel system.

95. The simulated platform bed system of claim 94, each of the first side panel, the second side panel, and the foot panel being rigid.

96. A framing kit for use with a bed system having a mattress support and a mattress, said mattress support adapted to support a lower surface of said mattress above a floor surface at a first height, said mattress having a first length between ends and a first width between sides, said mattress support having a head end and a foot end, the framing kit comprising:

first and second side panels each having a length between a head side and a foot side approximately equal to said first length and a height between a top side and a bottom side approximately equal to said first height;

a foot panel having a width between a left side and a right side approximately equal to said first width and a height between a top side and a bottom side approximately equal to said first height;

each of the panels having an exterior aspect having a decorative feature; and a plurality of brackets, the panels being cooperable to be situated in a set defining a U-shape with the exterior aspects thereof directed outwardly, the side panels defining the legs and the foot panel defining the yoke of the U-shape such that the set can be situated about and generally independent from said mattress support with the side panels adjacent said mattress support extending between said head end and said foot end and the foot panel adjacent said foot end spanning between the first and second side panels so as to create the appearance of a platform bed upon which said mattress appears to be supported, and the brackets being adapted to secure the side panels to the foot panel and/or secure at least one of the panels to said mattress support, wherein the mattress support of the bed system supports the mattress independently of the panels of the framing kit.

97. The framing kit of claim 96, each of the first side panel, the second side panel, and the foot panel being rigid.

98. A simulated platform bed panel system for use with a bed system having a mattress support adapted independently of the simulated platform bed panel system to support a lower surface of a bed mattress above a floor surface at a first height, said mattress having a first length between ends and a first width between sides, said mattress support having a head end and a foot end, the simulated platform bed panel system comprising:

first and second generally rectangular and rigid side panels each having a length between a head side and a foot side approximately equal to said first length and a height between a top side and a bottom side approximately equal to said first height, a pocket defined in the side panels adjacent the foot sides thereof;

a generally rectangular and rigid foot panel having a width between a left side and a right side approximately equal to said first width and a height between a top side and a bottom side approximately equal to said first height, pockets defined in the foot panel adjacent the left and right sides thereof;

generally flexible corner panels extending between respective pockets in the side panels and the pockets in the foot panel for providing a smooth transition between the side panels and the foot panel;

each of the side panels, the foot panel, and the corner panels having an exterior aspect having a decorative feature; the respective pockets being defined between the decorative feature of the respective panel and the respective panel, the panels being cooperable to be situated in a set defining a U-shape with the exterior aspects thereof directed outwardly, the side panels defining the legs and the foot panel defining the yoke of the U-shape such that the set can be situated about and generally independent from said mattress support with the side panels adjacent said mattress support extending between said head end and said foot end and the foot panel adjacent said foot end spanning between the first and second side panels so as to create the appearance of a platform bed upon which said mattress appears to be supported.

99. The simulated platform bed system of claim 98, each of the first side panel, the second side panel, and the foot panel being rigid.

* * * * *

UNITED STATES PATENT AND TRADEMARK OFFICE

CERTIFICATE OF CORRECTION

PATENT NO. : 9,089,222 B2
APPLICATION NO. : 13/434238
DATED : July 28, 2015
INVENTOR(S) : Richard Stewart et al.

It is certified that error appears in the above-identified patent and that said Letters Patent is hereby corrected as shown below:

In the Claims

Column 12, line 44, replace "corner panels, side panels, and foot panels" with --corner panels, side panels, and foot panel--.

Column 12, line 55, replace "side panels and the foot panels" with --side panels and the foot panel--.

Signed and Sealed this
Second Day of February, 2016

Michelle K. Lee

Michelle K. Lee
*Director of the United States Patent and Trademark Office*